US005843585A

United States Patent [19]

Alperine et al.

[11] Patent Number: 5,843,585

[45] Date of Patent: Dec. 1, 1998

[54] THERMAL BARRIER COATING WITH IMPROVED SUB-LAYER AND PARTS COATED WITH SAID THERMAL BARRIER

[75] Inventors: Serge Alexandre Alperine, Paris; Jean-Paul Fournes, Dannemois; Pierre Josso, Issy les Moulineaux; Jacques Louis Leger, Combs la Ville; André Hubert Louis Malie, Targe; Denis Georges Manesse, Chatellerault, all of France

[73] Assignees: Societe Nationale D'Etude et de Construction de Moteurs D'Aviation "Snecma" , Paris; Societe Sochata, Velizy-Villacoublay; Office National d'Etudes et de Recherche Aerospatiales (ONERA), Chatillon, all of France

[21] Appl. No.: 807,755

[22] Filed: Feb. 27, 1997

[30] Foreign Application Priority Data

Feb. 29, 1996 [FR] France ..... 96 02536

[51] Int. Cl.[6] ..... B22F 7/04

[52] U.S. Cl. ..... 428/623; 428/632; 428/633

[58] Field of Search ..... 428/623, 632, 428/633; 416/241 B; 462/629

[56] References Cited

U.S. PATENT DOCUMENTS

| | | | |
|---|---|---|---|
| 4,123,594 | 10/1978 | Chang | 428/651 |
| 4,321,311 | 3/1982 | Strangman | 428/623 |
| 4,401,697 | 8/1983 | Strangman | 427/250 |
| 4,880,614 | 11/1989 | Strangman et al. | 428/623 |
| 5,015,502 | 5/1991 | Strangman et al. | 427/248.1 |
| 5,238,752 | 8/1993 | Duderstadt et al. | 428/623 |
| 5,427,866 | 6/1995 | Nagaraj et al. | 428/610 |
| 5,514,482 | 5/1996 | Strangman | 428/623 |
| 5,562,998 | 10/1996 | Strangman | 428/612 |
| 5,624,721 | 4/1997 | Strangman | 427/585 |
| 5,645,893 | 7/1997 | Rickerby et al. | 427/405 |
| 5,652,044 | 7/1997 | Rickerby | 428/216 |
| 5,658,614 | 8/1997 | Basta et al. | 427/253 |
| 5,667,663 | 9/1997 | Rickerby et al. | 205/170 |
| 5,683,761 | 11/1997 | Bruce et al. | 427/596 |

FOREIGN PATENT DOCUMENTS

| | | |
|---|---|---|
| 0 587 341 | 3/1994 | European Pat. Off. . |
| 0 718 419 | 6/1996 | European Pat. Off. . |
| 2 041 246 | 9/1980 | United Kingdom . |
| 2 285 632 | 7/1995 | United Kingdom . |

*Primary Examiner*—Daniel J. Jenkins

*Attorney, Agent, or Firm*—Oblon, Spivak, McClelland, Maier & Neustadt, P.C.

[57] ABSTRACT

A thermal barrier coating for a superalloy part used, in particular, in turbomachines comprises a ceramic coating and a sub-layer interposed between the superalloy substrate and the ceramic coating, the sub-layer being composed of a nickel and/or cobalt aluminide containing at least one platinum-like metal and at least one metal for promoting the formation of a layer of oxide constituted by the alpha-allotropic variety of alumina.

11 Claims, 2 Drawing Sheets

| COATING | MASS CAPTURE ($mg/cm^2$) | THICKNESS OF ALUMINA ($\mu m$) |
|---|---|---|
| β-NiAl | 0.9 | 5.0 |
| β-(Ni,Pt)Al | 0.6 | 3.3 |
| β-(Ni,Pd)Al | 0.3 | 1.7 |
| NiCoCrAlY | 0.4 | 2.2 |
| NiCoCrAlYHf | 0.1 | 5.4 |

| ALLOY | Ni | Co | Cr | Ti | W | Ta | Mo | Re | Hf | C | Al |
|---|---|---|---|---|---|---|---|---|---|---|---|
| AM1 | BASE | 6.5 | 7.5 | 1.2 | 5.5 | 8 | 2 | | ⩽0.2 | ⩽100ppm | 5.3 |
| N5 | BASE | 7.5 | 7 | ⩽0.02 | 5 | 6.5 | 1.5 | 3 | 0.15 | 500ppm | 6.2 |
| IN100 | BASE | 15 | 10 | 4.5 | | | 3 | | | 0.18 | 5.5 |
| C1023 | BASE | 9.75 | 15.5 | 3.6 | ⩽0.2 | | 8.5 | | | 0.15% | 4.2 |
| AM3 | BASE | 5.5 | 8 | 2 | 5 | 3.5 | 2.25 | | | ⩽70ppm | 5.95 |
| PD21 | BASE | 1 | 6 | | 11 | | 2 | | | 0.1 | 6 |
| DS200 | BASE | 10 | 9 | 2 | 12.5 | | | | 1.75 | 0.11% | 5 |

*FIG. 1*

| COATING | MASS CAPTURE ($mg/cm^2$) | THICKNESS OF ALUMINA ($\mu m$) |
|---|---|---|
| $\beta$-NiAl | 0.9 | 5.0 |
| $\beta$-(Ni,Pt)Al | 0.6 | 3.3 |
| $\beta$-(Ni,Pd)Al | 0.3 | 1.7 |
| NiCoCrAlY | 0.4 | 2.2 |
| NiCoCrAlYHf | 0.1 | 5.4 |

*FIG. 2*

| TYPE OF SUB-LAYER | AVERAGE NUMBER OF CYCLES TO FLAKING |
|---|---|
| MCrAlY PLASMA UNDER VACUUM | 80 |
| MCrAlY EBPVD | 150 |
| SIMPLE ALUMINIDE | 150 |
| ALUMINIDE MODIFIED BY PLATINUM | 380 |
| ALUMINIDE MODIFIED BY PALLADIUM | 350 |

*FIG. 3*

| TYPE OF SUB-LAYER | AVERAGE NUMBER OF CYCLES TO FLAKING |
|---|---|
| MCrAlY PLASMA UNDER VACUUM | 5 |
| MCrAlY EBPVD | 12 |
| SIMPLE ALUMINIDE | 12 |
| ALUMINIDE MODIFIED BY PLATINUM | 20 |
| ALUMINIDE MODIFIED BY PALLADIUM | 18 |

*FIG. 4*

| TYPE OF SUB-LAYER | AVERAGE NUMBER OF CYCLES TO FLAKING |
|---|---|
| MCrAlY PLASMA UNDER VACUUM | 250 |
| MCrAlY EBPVD | 650 |
| SIMPLE ALUMINIDE | 600 |
| ALUMINIDE MODIFIED BY PLATINUM | 900 |
| ALUMINIDE MODIFIED BY PALLADIUM | 850 |

*FIG. 5*

THERMAL BARRIER COATING WITH IMPROVED SUB-LAYER AND PARTS COATED WITH SAID THERMAL BARRIER

BACKGROUND OF THE INVENTION

1. Field of the Invention

The invention relates to a thermal barrier coating including a sub-layer for superalloy metal parts, and is particularly applicable to turbomachine parts which are exposed to high temperatures during operation.

Manufacturers of turbine engines, whether ground-based or aeronautical, for over thirty years have been facing strong demands to increase the efficiency of turbomachines, to reduce their specific fuel consumption, and also to reduce polluting emissions of $CO_x$, $SO_x$ and $NO_x$, types and of non-burned residues. One of the ways in which these demands have been met involves getting closer to the fuel combustion stoichiometry, and thus increasing the temperature of the gases issuing from the combustion chamber and attacking the first stages of the turbine. This tendency in the development of turbomachines has remained a constant throughout the last thirty years.

Correspondingly, it has been found necessary to make the materials of the turbine compatible with this rise in the temperature of the combustion gases. One of the solutions entertained has involved improving the technology of turbine blade cooling. This development is based on the technologies of aero-thermodynamic computation and of precision casting, and involves a considerable increase in the technical aspects and the cost of producing the parts. Another solution has involved developing the refractory character of the materials used so as to increase the operating temperature limit and the creep and fatigue life. This solution was widely adopted when nickel and/or cobalt based superalloys appeared, and underwent considerable technical development in the transition from equiaxial superalloys to moncrystalline superalloys (a gain of 80° to 100° in creep). This method can nowadays be exploited only by meeting substantial development costs (providing socalled third generation superalloys able to allow an additional gain in creep of approximately 20° C.). Beyond this, a new change in the family of materials becomes necessary, the industrial viability of which has not so far been demonstrated.

An alternative to changing the family of materials involves depositing on the superalloy parts a heat-insulating coating termed "a thermal barrier". This insulating ceramic coating enables a cooled part in a steady operating regime to develop a thermal gradient through the ceramic, of which the total amplitude may be in excess of 200° C. The operational temperature of the underlying metal is decreased by a like amount, with considerable effect upon the volume of cooling air necessary, the life of the part, and the specific consumption of the engine. However, such a ceramic coating cannot generally be deposited directly onto the superalloy, and requires the interposition of a metallic sub-layer fulfilling a multiplicity of functions. This sub-layer forms a mechanical adaptation between the superalloy substrate and the ceramic coating.

The sub-layer is also useful to ensure adherence between the substrate and the ceramic coating:

adherence between the sub-layer and the substrate being effected by interdiffusion; and, adherence between the sub-layer and the ceramic coating being effected by mechanical anchoring and/or by the propensity of the sub-layer to develop, at high temperature, a thin layer of aluminum oxide at the ceramic/sub-layer interface.

Finally, the sub-layer ensures protection of the superalloy constituting the part against high temperature oxidation and hot corrosion types of degradation to which the part is subjected within the environment of the hot gases coming from the combustion chamber.

The manner in which this sub-layer performs these various roles has a considerable bearing on the practical efficiency of the thermal barrier, as the sub-layer will determine to a large extent the life of the ceramic coating before the thermal barrier becomes fully or partly detached, putting an end to the desired performance gains.

The thermal barrier coatings are generally composed of a mixture of oxides, in most cases based on zirconia. Indeed, this oxide offers a most interesting compromise between a material with a low thermal conductivity and a relatively high coefficient of expansion, close to that of nickel and/or cobalt based alloys on which it is desired to deposit the coating. One of the most satisfactory ceramic compositions is zirconia partly stabilized with yttrium oxide: $Zr0_2$+6 to 8% by weight $Y_20_3$. Other oxides may also be used to stabilize the zirconia, particularly the oxides of cerium, calcium, magnesium, lanthanum, ytterbium and scandium.

The ceramic coating may be deposited on the part to be coated using various processes, most of which belong to two distinct families, being either coatings that are sprayed or coatings that are physically deposited in a vapour phase.

For sprayed coatings, the deposition of zirconia based oxide is effected using techniques related to plasma spraying. The coating is constituted by a stack of molten ceramic droplets which are impact hardened, flattened and stacked so as to form an imperfectly dense deposit to a thickness or between 50 $\mu$m and 1 mm. One of the characteristics of this type of coating is an intrinsically high roughness (Ra being typically between 5 and 35 $\mu$m). The microstructure of this type of coating makes it little able to withstand shear stresses occurring in use as a result of thermal cycles, because of the expansion coefficient differential between the superalloy and the oxide. Its degradation mode in service is therefore characterized by the slow propagation of a crack in the ceramic parallel to the ceramic/metal interface. A cohesive rupture is thus involved. The mechanically weak point of the coating formed by the ceramic and the sub-layer is then not the ceramic/sub-layer interface proper, but rather the ceramic itself. Consequently, sub-layers well suited to this type of ceramic deposition are preferably very plastic at high temperatures, in order to compensate by their own deformation those imposed upon the ceramic by the expansion differential between it and the superalloy substrate.

In the case of coatings deposited physically in a vapour phase, the problem is substantially different. Such a deposition may be produced using processes such as electron bombardment evaporation. Its principal characteristic is that the coating is made up of an assembly of very fine small columns (typically between 0.2 and 10 $\mu$m in diameter) oriented substantially perpendicularly to the surface to be coated. The thickness of such a coating may range from 20 to 600 $\mu$m. Such an assembly has the interesting property of reproducing, without alteration, the surface condition of the substrate coated. In particular, in the case of turbine blades, it is possible to obtain a final roughness considerably less than one micrometre, which is very advantageous to the aerodynamic properties of the blade. Another consequence of the so-called "columnar" structure of ceramic depositions effected physically in the vapour phase is that the space situated between the small columns enables the coating to accommodate very effectively the compression stresses that it undergoes in service as a result of the expansion differential relative to the superalloy substrate. In this case, lengthy thermal fatigue lives at high temperatures may be reached, and the rupture of the coating no longer occurs in the ceramic itself, but through rupture of the sub-layer/ceramic interface. Consequently, the chief characteristic of a sub-layer adapted to this type of ceramic coating deposited physically in the vapour phase, aiming at an increased thermal fatigue life, is the reinforcement of this interface, and thus of the adherence between the ceramic and the sub-layer.

2. Summary of the Prior Art

Several types of sub-layers have so far been used for thermal barrier coatings. U.S. Pat. Nos. 4,321,311 and 4,401,697 describe sub-layers of alumino-former alloys of MCrAlY type (M=Ni and/or Co and/or Fe). These sub-layers suffer from the drawback of being deposited in the same way as the ceramic, either by thermal spraying processes, or vapour phase deposition processes. These two types of processes are directional, and thus make very difficult the homogeneous coating of turbine parts such as doublets of flow straightener blades. Another drawback is the high cost of these deposition processes. Finally, thermal barrier coatings obtained by these processes do not always provide sufficient working lives. High temperature diffusion of metal superalloy elements towards MCrAlY sub-layers in fact tends to limit, over time, their qualities of protection against oxidation and heat corruption.

In addition, U.S. Pat. No. 5,238,752 teaches that it is possible to use protective coatings of simple NiAl aluminides and platinum-modified aluminides to act as thermal barrier sub-layers, particularly when the ceramic layer is composed of small columns and preferentially made by physical deposition in the vapour phase. None of these sub-layers is entirely satisfactory. Indeed, simple aluminides of NiAl of CoAl type display inadequate oxidation resistance at very high temperatures, and thus do not act effectively as a thermal barrier sub-layer for parts subjected to extreme temperatures over long periods. Platinum-modified aluminides have proved to be more interesting, leading generally to much superior thermal fatigue lives for the coating. However, they also suffer from some drawbacks. Depending upon the type of superalloy substrate used, and the aluminization conditions after platinum deposition, there is a danger of obtaining a sub-layer of great external hardness. Moreover, platinum is a metal which is both very expensive and very dense, which makes the production of this type of sub-layer very costly. In addition, in the case of sub-layers of simple aluminide, and also the case of platinum-modified aluminide sub-layers, it has been found that the adherence of the layer of alumina formed by oxidation of the sub-layer/ceramic interface is sometimes insufficient, leading to working lives for the thermal barrier coating which are too short. The authors have observed that this defective adherence is reproducibly dependent upon the chemical composition of the substrate superalloy.

SUMMARY OF THE INVENTION

It is an object of the invention to provide a thermal barrier coating comprising a ceramic coating of columnar structure and a sub-layer which adheres strongly to the ceramic and to the superalloy to be coated, the sub-layer being formed so as to ensure an increased adherence of the interface alumina layer in all circumstances, to withstand the phenomena of high temperature inter-diffusion with the superalloy, and to offer excellent resistance to stresses of the hot corrosion type, whereby the coating obtained has an increased working life and greater reliability.

To this end, the invention resides in making a thermal barrier sub-layer from an aluminide and introducing into the sub-layer at least one platinum-like metal with which there is associated at least one metal for promoting the formation of the alpha allotropic variety of alumina.

The platinum-like metal enables an oxide layer of good quality to be maintained over a longer period than would be the case with a simple aluminide.

Using the metal for promoting the alpha allotropic variety of alumina increases the adherence of the oxide layer formed between the sub-layer and the ceramic.

More particularly, according to the invention there is provided a thermal barrier coating for a superalloy substrate comprising a ceramic coating and a sub-layer interposed between said substrate and said ceramic coating, said sub-layer being composed of a nickel aluminide and/or cobalt modified by at least one platinum-like metal and including, at least in an upper part of said sub-layer, in contact with said ceramic coating, a metal for promoting the formation of a layer of oxide constituted by the alpha-allotropic variety of alumina.

The platinum-like metal is preferably selected from the group consisting of platinum itself, palladium, ruthenium and combinations of these metals.

When palladium is used, the amount of palladium introduced into the sub-layer is preferably between 3 and 40 mole %.

The metal for promoting the alpha allotropic variety of alumina is preferably selected from the group consisting of chromium, iron, manganese, and combinations of these metals.

The amount of the metal for promoting the formation of the alpha allotropic variety of alumina introduced into the sub-layer is preferably from 0.1% to 10% by weight.

The thickness of the sub-layer may be between 10 $\mu$m and 500 $\mu$m, and is preferably between 50 and 100 $\mu$m.

The ceramic preferably has a columnar structure and a base of zirconia, preferably stabilized with yttrium oxide. The thickness of the ceramic coating may be between 20 $\mu$m and 600 $\mu$m, and preferably between 50 and 250 $\mu$m.

The invention also relates to a superalloy part having such a thermal barrier coating.

BRIEF DESCRIPTION OF THE DRAWINGS

FIG. 1 is a table indicating the composition of various alloys as percentages by weight;

FIG. 2 is a table giving the mass capture after 100 hours of isothermal oxidation at 1100° C. of various coatings formed on the AM1 alloy in accordance with the invention, and the corresponding alumina thickness;

FIG. 3 is a table giving the average numbers of cycles to flaking for various types of sub-layers subjected to cyclic oxidizing tests carried out under the same conditions;

FIG. 4 is a table similar to that of FIG. 3 but showing the results when the sub-layers are subjected to cyclic oxidizing tests carried out under conditions different to those of the FIG. 3 test; and, FIG. 5 is a table similar to those of FIGS. 3 and 4 but showing the results when the conditions under which the oxidizing tests are carried out are different again from those of the tests of FIGS. 3 and 4.

DETAILED DESCRIPTION OF THE INVENTION AND THE PREFERRED EXAMPLES

The thermal barrier coating for a superalloy substrate of the invention includes a ceramic coating and a sub-layer interposed between the ceramic and the substrate.

The adherence between the ceramic and the sub-layer immediately after effecting the ceramic deposition is limited. On the other hand, as soon as the coating is raised to a high temperature in an oxidizing atmosphere, there is formed at the ceramic/sub-layer interface a protective oxide layer which is also very adherent to the ceramic. This oxide layer considerably reinforces the adherence between the ceramic and the sub-layer. It is believed that, for thermal barrier coatings applied by physical deposition in the vapour phase, with a ceramic/sub-layer interface which is, consequently, not very rough, it is the durability over time and the adherence of this oxide layer which will, for the most part, determine the life of the coating in the face of stresses of the thermal fatigue type. A good sub-layer for a thermal barrier coating of columnar structure must therefore possess the following qualities:

- the ability to form, by high temperature oxidation, a protective oxide layer which is stable, grows very slowly, is free from growth stresses, is adherent to metal, and is adherent to the ceramic coating;
- to be preferably single-phased;
- the ability to withstand satisfactorily the phenomenon of high temperature interdiffusion with the substrate;
- to have excellent resistance to thermal corrosion type stresses in the presence of molten salts of sulphate and/or vanadate type;
- to be able to coat parts of complex shape homogeneously (little or non directional deposition processes); and
- to be attractive in economic terms.

In the case of the present invention, it is proposed to use as the sub-layer a coating of a nickel aluminide and/or cobalt modified by a platinum-like metal such as palladium in particular. Palladium is a noble metal endowed with a very strong chemical affinity with the nickel aluminide β-NiAl. It is possible to incorporate in a coating of a nickel aluminide of the β-NiAl type, up to 35 or 40 mole % a of palladium without modifying its crystallographic structure. Palladium in solid solution in a nickel aluminide plays several roles.

Palladium, and other platinum-like metals, increases significantly the thermodynamic activity of aluminum and thus enables the alloy to remain an aluminoformer even when a substantial part of the aluminum reserve of the coating is exhausted. The practical consequence of this is that, under identical conditions of use, a sub-layer made of an aluminide modified by a platinum-like metal will maintain a good quality oxide layer for a longer period than would a sub-layer of simple aluminide.

Palladium, and the other platinum-like metals, also increases substantially the coefficient of diffusion of the aluminum in nickel aluminide. Thus, the aluminum can diffuse more easily towards the outer surface of the sub-layer to compensate the progressive impoverishment of the latter during the formation of an interface layer of alumina. This phenomenon ensures a better availability of the reserve of aluminum in the sub-layer to form a durable alumina interface layer, as compared with a sub-layer made of a palladium-free aluminide.

Palladium has a steric effect in β-NiAl type aluminides which facilitates the ascent mechanisms of dislocations and enables the sub-layer to accommodate the growth stresses exerted on the interface alumina layer as a result of the lack of agreement between the parameters of the crystalline network of the metal constituting the superalloy and the alumina. The presence of palladium permits an interface alumina layer to be obtained which is less stressed, and is thus both more compact and more adherent to the metal of the sub-layer than in the case of the oxidation of an aluminide in the absence of palladium.

Finally, palladium respects the crystallographic nature of β-NiAl type aluminide and leads to sub-layers possessing the same type of ductility as simple aluminide, contrary to the case of platinum-modified aluminides. This property may be observed by a measurement of the Vickers hardnesses of the various sub-layers in their outer part, and also in a metallographic section by the absence of cracks in the outer part of the sub-layer, as will be described later with reference to the examples.

There are many ways of producing a thermal barrier sub-layer made of an aluminide modified by palladium. For example, it is possible to utilize the teachings of French patent application No. 2638174 or it is possible to proceed as described in the examples hereinbelow.

Among the platinum-like metals, the use of palladium in a modified aluminide sub-layer offers a clear economic advantage compared with using platinum. However, platinum and palladium are not the only elements able to promote the formation of layers of alumina of good quality when they are alloyed with the NiAl intermetallic of beta structure. In particular, ruthenium also has this interesting collection of properties. Furthermore, the sub-layer may include several of the platinum-like metals, such as an alloy of palladium and/or platinum and/or ruthenium.

Another important aspect of the invention lies in the use of at least one metal for promoting the formation of the alpha allotropic variety of alumina, such as chromium, combined with the platinum-like metal in the thermal barrier sub-layer. Indeed, chromium plays a part of paramount importance in the formation of the interface alumina layer, particularly during the first hours of exposure to high temperatures. The addition of small amounts of chromium (ranging from 0.1 to 10% by weight, for example) in the thermal barrier sub-layer has the effect of promoting the almost immediate formation of the alpha allotropic variety of alumina by epitaxial growth on $Cr_2O_3$ chromium oxide nodules.

In the absence of chromium, the oxidation of the sub-layer begins with the formation of alumina of θ allotropic variety. This θ variety of alumina is highly stressed and poorly adherent to the underlying metal. Subsequently, the thermodynamically stable alpha variety is also formed, but only over a sub-layer of oxide which, although discontinuous, is poorly adhering and hence limits the overall adherence of the oxide layer. Moreover, this transformation $Al_2O_3\theta \rightarrow Al_2O_3\alpha$ a is accompanied by a pronounced change in volume of the crystallographic mesh, which produces high stresses in the oxide layer and is thus detrimental to its adherence to the underlying metal. These two phenomena, taken as a whole, are very injurious to the life of a thermal barrier deposited on such a sub-layer.

In the presence of chromium, on the other hand, the adherence of the oxide layer is strengthened by the fact that the alpha variety of alumina forms immediately. Other metals promoting the formation of the alpha allotropic variety of alumina may also be used, such as, for example, iron and/or manganese. However, in the remaining description, the examples will be restricted to the use of chromium, which has the additional advantage of improving the resistance of the coating to hot corrosion.

In order that the chromium introduced into a sub-layer made of an aluminide modified by a precious metal of the platinum type may effectively promote the formation of the alpha allotropic variety of alumina, the said chromium must be present in a sufficient amount in the upper part of the sub-layer where the interface alumina layer is formed. The introduction of chromium into the upper part of the sub-layer may be effected in different ways.

When the superalloy substrate contains enough chromium, the introduction of chromium into the sub-layer may be effected by a suitable heat treatment which causes the diffusion of chromium from the substrate towards the surface of the sub-layer. In this case, the substrate is preliminarily coated with a modifying layer containing a precious metal of the platinum type, for example a deposition of nickel-palladium, followed by a diffusion annealing operation, the temperature and duration of which are chosen in such a way that the diffusion of the platinum-like metal into the substrate is shallow and enables the diffusion of chromium from the substrate towards the surface of the modifying layer.

To this end, because the activation energy barrier for the diffusion of a precious metal such as platinum or palladium is high relative to that of chromium, diffusion annealing is performed a t a temperature below a limit temperature above which the precious metals of the platinum type diffuse more rapidly than chromium. Preferably, the diffusion annealing temperature is chosen to be less than 1100° C., and preferably below 900° C. The duration of diffusion annealing is adapted to the chosen annealing temperature and to the chromium concentration desired in the upper part of the sub-layer.

Typically, the annealing time exceeds one hour, and is preferably two hours o r more.

The diffusion annealing is then followed by an aluminization operation.

When the superalloy substrate does not contain enough chromium, or the chromium contained in the substrate is insufficiently mobile, the addition of chromium into the sub-layer may be carried out by a chromization operation. In this case, the chromization operation must be performed just before, or during, the aluminzation operation, so that, on the one hand, the chromium will be found in the outermost part of the final coating and, on the other hand, the formation of a diffusion barrier for all of the sub-layer elements is avoided, should the chromium be deposited as a continuous layer.

Examples 1 to 4 described hereinafter illustrate different methods of achieving sub-layers in accordance with the invention, and show the connection between the composition and the method of producing the sub-layer and its intrinsic qualities, namely:

- slow growth kinetics of the oxide layer at high temperature;
- limited hardness and absence of fissuring of the sub-layer, ensuring that the coating is not brittle;
- resistance of a superalloy coated with the sub-layer in cycled oxidation, showing the quality of adherence of the alumina layer to the sub-layer; and,
- resistance of a superalloy coated with the sub-layer to hot corrosion.

In all of these examples, the sub-layers are produced on a nickel-based superalloy substrate, such as IN 100, AM 3, AM 1, DS 200, PD 21, C 1023 and N 5, the compositions of which are given in the Table of FIG. 1.

EXAMPLE 1

Approximately 10 $\mu$m of a palladium-nickel alloy containing 20% nickel by weight was deposited electrolytically on a nickel-based substrate selected from the alloys given in FIG. 1. The sample was then subjected to a diffusion heat treatment at 850° C. for two hours, under an air pressure of not more than $10^{-5}$ Torr. This heat treatment ensures, in addition to a better adherence of the electrolytic deposit to the substrate, a diffusion of part of the chromium contained in the substrate towards the surface of the said electrolytic deposit. For the sake of example, when using a IN100 substrate, a chromium concentration equal to 2.5% by weight was obtained at the surface of the electrolytic deposit of the palladium-nickel alloy. A coating of nickel aluminide of standard low activity type was then produced on this sample by case hardening. At the end of this operation, the sample has a sound surface and a satin pink colour. A metallographic section made perpendicularly to the surface shows that the coating obtained is about 60 $\mu$m thick, single phased, and that its structure is divided into three zones of unequal thickness. The first zone situated at the top of the coating is about 30 $\mu$m thick and exhibits a negative gradient of palladium concentration (the palladium concentration decreasing from the top of the coating down to the substrate). The composition of this zone may be written thus:

$$\beta\text{-}(Ni_x, Pd_{1-x})Al, \text{ with } 0.4 \leqq x \leqq 0.9$$

The second zone, which is approximately 20 $\mu$m thick, is composed of nickel aluminide of the β-NiAl type and containing a little palladium in solid solution. These two zones further contain chromium in a weight ratio of from 0.5% to 5%. The presence of chromium in the sub-layer, and in particular in the upper part of the sub-layer, ensures the immediate formation of the alpha allotropic variety of alumina which is very adherent to the underlying metal. Finally, the third zone, which is approximately 10 $\mu$m thick, is characteristic of the coatings obtained by diffusion. It should be noted that micro-hardness measurements carried out on this coating have shown that they were equivalent to those obtained from a simple aluminide coating. This shows that the sub-layer of the invention is not very brittle and not very likely to crack in service.

Identical coatings, obtained on the same type of substrate, were subjected to oxidation tests at 1100° C., and to corrosion tests at 850° C. in the presence of molten sodium sulphate. These two types of tests are cycled: a cycle consisting of raising the temperature of the sample tested from approximately 200° C. (or from ambient temperature if this is the first cycle) to test temperature (1100° C. for oxidizing, or 850° C. for corrosion) in approximately 5 minutes, maintaining this temperature for an hour, and cooling the sample down to about 200° C. in less than 5 minutes by forced convection of air. In the case of a corrosion test, the sample is also contaminated by a deposition of about 50 $\mu g/cm^2$ of sodium sulphate ($Na_2SO_4$) every 50 cycles. In all cases, at the end the tests extended up to 1000 cycles of 1 hour there was observed an oxidizing and hot corrosion stability identical to that observed with a coating of nickel aluminide modified by a pre-deposition of platinum such as RT22 marketed by Cromalloy U.K.

An identical coating, formed on a similar type of substrate, was subjected to an isothermal oxidation at 1100° C. for 100 hours. The aim of this test was to prepare a substrate for receiving the deposition of a thermal barrier, the substrate being precoated with a sub-layer resistant to oxidation and hot corrosion. At the end of the test a mass capture of 0.3 $mg/cm^2$ was observed, corresponding to a thickness of alumina of about 1.7 $\mu$m. A micrographic examination of the layer of alumina obtained shows that it is dense, continuous and adherent. As a comparison, the thickness of alumina obtained on a simple nickel aluminide may reach 5 $\mu$m after 100 hours of isothermal oxidation in identical conditions. Moreover, the structure of such a fast growing layer is greatly disrupted and presents risks of exfoliation which are detrimental to good adherence of a thermal barrier.

The mass capture rates and the thicknesses of alumina obtained under the same conditions after 100 hours of isothermal oxidation at 1100° C. for different coatings produced on a nickel-based substrate are given in the table shown in FIG. 2. This table shows that the sub-layer β(Ni, Pd) Al in accordance with the invention is that which, for a given time and oxidation conditions, offers the finest oxide layer, i.e. the slowest growth. This illustrates one of the fundamental qualities of the coating as a thermal barrier sub-layer, namely that which permits the formation of a slower growing interface oxide layer imparting an increased thermal fatigue life to the thermal barrier.

EXAMPLE 2

The modus operandi adopted was as in Example 1, except for replacing the low activity case aluminization by a low activity aluminization in the vapour phase (termed "APVS"). For this procedure the nickel-based substrate was covered with a pre-deposition of palladium-nickel approximately 10 μm thick, followed by annealing at an air pressure of less than $10^{-5}$ Torr for 2 hours at 850° C. The substrate was then introduced into a semi-sealed box containing an aluminum donor case-hardening mixture constituted by coarse granules of an alloy of chromium and aluminum activated by 1% by weight of ammonium bifluoride ($NH_4F$, HF). The whole was then heated to 1050° C. for 15 hours in argon. At the end of this operation the sample had a sound, glossy pink surface. A metallographic section taken perpendicularly to the surface revealed that the coating obtained was about 60 μm thick, single phased, and with a structure divided into three zones of unequal thickness. The thicknesses and the compositions of each of the three zones were identical to those of the zones obtained in Example 1. Oxidation tests at high temperature, thermal corrosion tests and isothermal oxidation at 1100° C. gave results comparable to those recorded in Example 1. However, it should be noted that the roughness of the coating is exceptionally low (Ra being of the order of 1 μm), which in conjunction with its thermal corrosion resistance properties, makes it particularly suitable as a thermal barrier sub-layer for micro-columnar coatings produced by physical deposition in a vapour phase.

EXAMPLE 3

The modus operandi adopted was as in Example 1, except for replacing the low activity case aluminization by high activity aluminization deposited by a paint-on deposition. For this, the nickel-based substrate was covered by a pre-deposition of palladium-nickel to a thickness of approximately 10 μm, then annealed in air at a pressure of less than $10^{-5}$ Torr for 2 hours at 850° C., and coated with aluminizing paint of Sermaloy J type marketed by Sermatch Inc. The thickness of the coat of paint deposited was about 100 μm. After drying in air for half an hour at 80° C., and a pre-diffusion operation in air at 350° C. for half an hour, as specified in the instructions given by the product's manufacturers, the whole was then heated to 1020° C. in argon for four hours. At the end of this operation, the sample presented a sound, black surface. After a micro-sanding operation intended to eliminate the slag inherent in this type of aluminization, the sample exhibited a dark pink colour characteristic of a coating modified by a palladium pre-deposition. A metallographic section taken perpendicularly to the surface shows that the coating obtained is about 60 μm thick, single-phased, and with a structure divided into three zones of unequal thickness. The first zone, situated at the top of the coating is about 30 μm thick and has a negative gradient of palladium concentration (from the top of the coating towards the substrate). The composition of this zone may be written as $$\beta\text{-}(Ni_x, Pd_{1-x})Al, \text{ with } 0.4 \leqq x \leqq 0.9$$

The second zone is about 20 μm thick and is composed of nickel aluminide of the β-NiAl type, containing a little amount of palladium in solid solution. These two zones also contain chromium in a proportion of from 0.5% to 5% by weight. Finally, the third zone is about 10 μm thick and is characteristic of coatings obtained by diffusion. This coating also contains molecules such as silicon (promoting a good adherence of the oxide layer formed in service), silica and traces of phosphorus. It should be noted that microhardness measurements taken on this coating have shown that they were always equivalent to that of a simple aluminide coating.

Tests for high temperature oxidation, hot corrosion, and isothermal oxidation at 1100° C. gave results comparable to those noted in Example 1.

EXAMPLE 4

The modus operandi was as for Example 2, except for modifying the palladium-nickel pre-deposition. For this, the nickel-based substrate was preliminarily coated with a pre-deposition of palladium-nickel as in Example 2, but to a thickness of about 15 μm. Then, 2 μm of electrolytic chromium was deposited from a standard hard chromium bath. This chromium deposition may constitute a source of metal for promoting the alpha-allotropic variety of alumina. The whole was then annealed at an air pressure below $10^{-5}$ Torr for 2 hours at 850° C., and aluminized as in Example 1. At the end of this operation the sample presented a sound surface of satin pink colour. A metallographic section taken perpendicularly to the surface shows that the coating obtained is about 60 μm thick, biphased, and with a structure divided into three zones of unequal thickness. The first zone situated at the top of the coating is about 30 μm thick, and exhibits a negative gradient of palladium concentration (from the top of the coating towards the substrate). The composition of this zone may be written as $$\beta\text{-}(Ni_x, Pd_{1-x})Al, \text{ with } 0.4 \leqq x \leqq 0.9$$

Moreover, there are observed in this zone fine precipitations of α Cr, characteristic of an aluminization modified by chromium. The second zone is about 20 μm thick and is composed of β-NiAl type nickel aluminide containing a small amount of palladium in solid solution. Finally, the third zone is about 10 μm thick and is characteristic of the coatings obtained by diffusion. However, it will be noted that this zone seems to be less disturbed than in the foregoing examples. This is due to the fact that the chromium of the substrate has diffused less towards the coating being built up, as this element was present in the modified pre-deposition.

Micro-hardness measurements taken on this coating have shown that they were equivalent to those of a simple aluminide coating modified by chromium (460 $Hv_{50}$). Tests for oxidation at high temperature, hot corrosion and isothermal oxidation at 1100° C. gave results comparable with those noted in Example 1, and even greater in the case of hot corrosion.

Examples 5 to 8 described hereinafter are illustrations of a ceramic coating of the thermal barrier type including a sub-layer as described in Examples 1 to 4 above.

EXAMPLE 5

Palladium modified aluminide coatings were deposited by the process described in Example 1 on N5 alloy disks 25 mm in diameter and 6 mm thick. N5 alloy has the composition given in the Table shown in FIG. 1, and is a monocrystalline superalloy used in the manufacture of turbine blades and guides. On one face of these disks there was subsequently deposited a thermal barrier coating of yttriated zirconia ($ZrO_2$ containing 6 to 8% by weight of $Y_2O_3$) to a thickness substantially equal to 125 $\mu$m. This coating was deposited by evaporation under electronic bombardment at a temperature close to 850° C., using a technique described, for example, in U.S. Pat. No. 5,087,477. At the same time, this ceramic coating was also deposited on disks of the same alloy which were preliminarily coated, either with a sub-layer of MCrAlY deposited by plasma projection at reduced pressure, or with a sub-layer of MCrAlY, produced by electronic bombardment evaporation (EBPVD), these two sub-layers corresponding to the state of the art as described in U.S. Pat. Nos. 4,321,311 and 4,401,697. Samples of the same nature were also produced with sub-layers made of simple NiAl aluminide and platinum-modified aluminide, such as described in U.S. Pat. 5,238,752.

These samples were subjected to a cyclic oxidizing test in a furnace. For this purpose, they were introduced into a furnace pre-heated to a temperature of 1135° C. in air in a laboratory, this temperature being reached by the samples in 10 minutes. They were kept at this temperature for one hour, then removed from the furnace and cooled by forced air convection so as to reduce their surface temperature to 200° C. in approximately 4 minutes, thus producing a thermal shock. They were subsequently reintroduced into the furnace for a new cycle. The samples were thus cycled until approximately a 10% flaking of the surface covered with the thermal barrier was observed.

The number of cycles completed before such flaking was observed for the various samples are given in the Table shown in FIG. 3.

This test shows that the palladium-modified sub-layer in accordance with the invention imparts to the thermal barrier coating a flaking resistance much higher than that of the standard sub-layers and comparable with that of the sub-layer of aluminide modified by platinum according to the prior art, but at a much lower production cost.

EXAMPLE 6

Samples identical with those described in Example 5 were subjected to a cyclic oxidization test identical to that described in example 5, except that the test temperature was 1100° C. and the duration of the cycles were 24 hours.

The numbers of cycles completed before flaking was observed for the various samples are indicated in the Table shown in FIG. 4.

It is again seen in this test that the palladium-modified sub-layer in accordance with the invention imparts to the thermal barrier coating a very advantageous flaking resistance.

EXAMPLE 7

Samples identical with those described in Example 6 were subjected to a cyclic oxidizing process in which an oxypropane flame is used to heat the surface of the samples to 1135° C. in 10 to 20 seconds. The samples were retained at this temperature for 6 minutes, and then were cooled very rapidly. This type of test produces very severe thermal shocks in the thermal barrier coating. The number of cycles completed before flaking occurred during this test is given in the Table shown in FIG. 5.

It is again seen that the sub-layer in accordance with the invention imparts to the thermal barrier coating a very advantageous flaking resistance.

EXAMPLE 8

Samples according to Example 7 were produced with different alloys, such as IN100 superalloys, as the substrate, and were tested according to the three testing methods described in Examples 5,6 and 7. In all cases, it was found that the life of the thermal barrier coatings obtained with a sub-layer in accordance with the invention is much longer than that obtained with sub-layers of MCrAlY type or of simple aluminides.

The invention is not, of course, limited to the examples which have been described. In particular the thickness of the sub-layer may differ from that chosen in the examples, being preferably between 10 $\mu$m and 500 $\mu$m.

Also, the amounts of the platinum-like metal and the metal for promoting the formation of a layer of oxide constituted by the alpha-allotropic variety of alumina may differ from those chosen in the examples.

Furthermore, the invention is not limited to the use of palladium as the platinum-like metal, but covers all platinum-like metals such as, in particular, platinum itself and ruthenium, as well as combinations of these metals.

Similarly, the invention is not limited to the use of chromium as the metal for promoting the formation of the alpha-allotropic variety of alumina, but also covers the use of manganese, iron and combinations of these metals.

We claim:

1. A coated article comprising a superalloy substrate, a protective, thermal barrier ceramic coating and a sub-layer interposed between said substrate and said ceramic coating, said sub-layer being composed of a nickel aluminide and/or cobalt aluminide modified by at least one metal selected from the group consisting of platinum, palladium, ruthenium, and combinations thereof, and including, at least in an upper part of said sub-layer, in contact with said ceramic coating, a metal for promoting the formation of a layer of oxide constituted by the alpha-allotropic variety of alumina.

2. A coated article according to claim 1, wherein said metal is palladium, and the amount of palladium in said sub-layer is proportionally between 3% and 40% by moles.

3. A coated article according to claim 1, wherein said metal for promoting the formation of the alpha-allotropic variety of alumina is selected from the group consisting of chromium, iron, manganese, and combinations of these metals.

4. A coated article according to claim 3, wherein the amount of said metal for promoting the formation of the alpha-allotropic variety of alumina in said sub-layer is proportionally from 0.1% to 10% by weight based on the weight of said sub-layer.

5. A coated article according to claim 1, wherein the thickness of said sub-layer is between 10 $\mu$m and 500 $\mu$m.

6. A coated article according to claim 1, wherein said ceramic coating has a columnar structure and is zirconia-based.

7. A coated article according to claim 6, wherein said zirconia is stabilized with yttrium oxide.

8. A coated article according to claim 1, wherein the thickness of said ceramic coating is between 20 μm and 600 μm.

9. A coated article according to claim 1, wherein said sub-layer is such that a metallographic section made perpendicularly to the surface reveals that the sub-layer coating is divided into three zones of unequal thickness, the first zone being situated at the top of the coating and having a palladium concentration which decreases from the top of the coating down to the substrate, this first zone having a composition corresponding to the formula $$\beta\text{-}(Ni_x, Pd_{1-x})Al, \text{ with } 0.4 \leq x \leq 0.9$$

a second zone thinner than said first zone and composed of a nickel aluminide containing palladium in solid solution, and a third zone which is thinner than said first and second zones, said first and second zones containing chromium in a ratio of from 0.5% to 5%.

10. A coated article according to claim 3, wherein said metal for promoting the alpha-allotropic variety of alumina is chromium.

11. The process of claim 10, wherein said chromium is introduced into the upper part of said sub-layer by a chromization operation.

* * * * *

UNITED STATES PATENT AND TRADEMARK OFFICE

CERTIFICATE OF CORRECTION

PATENT NO. : 5,843,585
DATED : December 1, 1998
INVENTOR(S) : Serge Alexandre Alperine et al.

It is certified that error appears in the above-identified patent and that said Letters Patent is hereby corrected as shown below:

Column 2,
Line 33, "thickness or" should read -- thickness of --.

Column 7,
Line 19, "a t" should read -- at --.
Line 28, "o r" should read -- or --.

Signed and Sealed this

Eighteenth Day of December, 2001

*Attest:*

*Attesting Officer*

JAMES E. ROGAN
*Director of the United States Patent and Trademark Office*